US005710534A

United States Patent [19]

Lanoue et al.

[11] Patent Number: 5,710,534

[45] Date of Patent: Jan. 20, 1998

[54] ELECTRICAL APPARATUS INCLUDING ELECTRIC FIELD CONTROL MEANS

[75] Inventors: Thomas J. Lanoue, Cary, N.C.; Terry D. Barber, Newport News; Michael E. Haas, Yorktown, both of Va.

[73] Assignee: ABB Power T&D Company Inc., Raleigh, N.C.

[21] Appl. No.: 428,392

[22] Filed: Apr. 25, 1995

[51] Int. Cl.[6] ..... H01F 38/20; H01F 27/29

[52] U.S. Cl. ..... 336/192; 336/174

[58] Field of Search ..... 336/192, 173, 336/174, 175

[56] References Cited

U.S. PATENT DOCUMENTS 3,546,647 12/1970 Roddy et al. ..... 336/92

5,202,621 4/1993 Reischer ..... 336/175

*Primary Examiner*—Michael L. Gellner

*Assistant Examiner*—Daniel Chapik

*Attorney, Agent, or Firm*—Woodcock Washburn Kurtz Mackiewicz & Norris LP

[57] ABSTRACT

A coil for an electrical apparatus such as a transformer is disclosed which includes an electric field control means to minimize flashover or arching at a lead of the coil.

15 Claims, 2 Drawing Sheets

ELECTRICAL APPARATUS INCLUDING ELECTRIC FIELD CONTROL MEANS

BACKGROUND OF THE INVENTION

This invention relates generally to electrical apparatus, and more particularly, to electrical transformers and their coil windings. While the present invention was made in conjunction with dry-type cast coil transformers and will be described herein in association with a dry-type cast coil transformer, the present invention is in no way limited to cast coil applications.

In cast coil transformer construction, the coil windings are locked into a molded form protected from power surge distortion and hostile environments by epoxy. Typically, the high and low voltage coils are cast in epoxy as separate components, then are assembled onto the transformer core. Such cast coil transformers provide very high short circuit strength and high basic impulse levels or BIL.

It may be explained here that a conductor forming a coil has a start lead and a finish lead, i.e. the coil starts at one end, is wound into its coil form and finishes at the other end with a lead at both ends of the coil, and each lead is comprised of a conductive wire with or without insulation disposed around the conductive wire.

In a cast coil transformer as the finish lead, for example, exits from or passes through the epoxy cones, as shown in the drawings herein, there is a possibility that the electric field which is generated when current flows through the lead may effect or result in flashover and arcing to other "live" parts in the vicinity of the cones/finish lead, i.e., parts energized by a voltage or carrying current, of the transformer or to a grounded part of the transformer.

This is because when a voltage is applied between two electrodes, a dielectric field will exist. As for example, if another conductor or grounded portion of the transformer is brought into proximity to any of the cones/finish lead, as shown in the drawings herein, a dielectric field will exist and the closer the other conductor or grounded portion is to the lead passing through the cones, as shown in the drawings herein, the greater the dielectric stress on the dielectric material making up such cones. If the surface of the electrodes are round and smooth, the potential, with respect to one conductor, is equal at all points. However, when considering two conductors, the dielectric stress is greater in the area on the surface of each conductor that is nearest to the other. The smaller the radius of the conductor, the greater the dielectric stress. As indicated above, dielectric stress also becomes greater the closer the conductors come to each other.

In accordance with the invention, such flashover or arcing is minimized or eliminated by application of the electric field control means of the present invention to a lead of the coil winding.

SUMMARY OF THE INVENTION

In accordance with one aspect of the invention, a coil for an electrical apparatus is provided. The coil includes a lead through which an electrical connection may be made to the coil and electric field control means electrically connected to the lead and being physically adjacent to the lead is provided.

In accordance with another aspect of the invention, a transformer comprising at least one coil is provided. The coil has at least one lead through which electrical connection may be made to the transformer. Field control means are disposed in surrounding relationship to the at least one lead for controlling the electric field generated in the at least one lead when the lead is carrying current.

BRIEF DESCRIPTION OF THE DRAWINGS

Reference is now made to the description of the preferred embodiment of the invention, illustrated in the accompanying FIGS, in which.

DESCRIPTION OF THE PREFERRED EMBODIMENT

Figure 1:
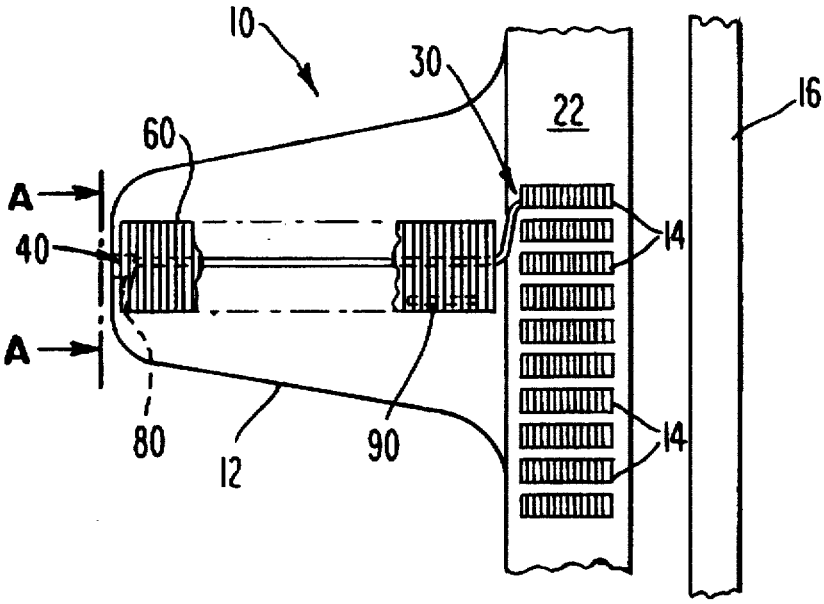
FIG. 1 is a view, partially in section and partially in elevation, diagrammatically depicting a portion of a dry-type transformer having a cast coil construction.

Referring now to the drawings in which like reference numerals refer to like parts throughout the several views and more particularly to FIG. 1, there is shown generally at 10 a portion of a dry-type transformer. The cone shaped portion or cone 12 depicts, for example, the section of the transformer comprising a high voltage tap for the transformer. Transformer coil or disc windings are shown at 14 and the transformer's core is partially depicted at 16 in FIG. 1. The transformer core is not shown or depicted in FIGS. 2 and 3. The discs 14 are formed by winding rectangular conductor on top of itself for several turns.

Figure 2:
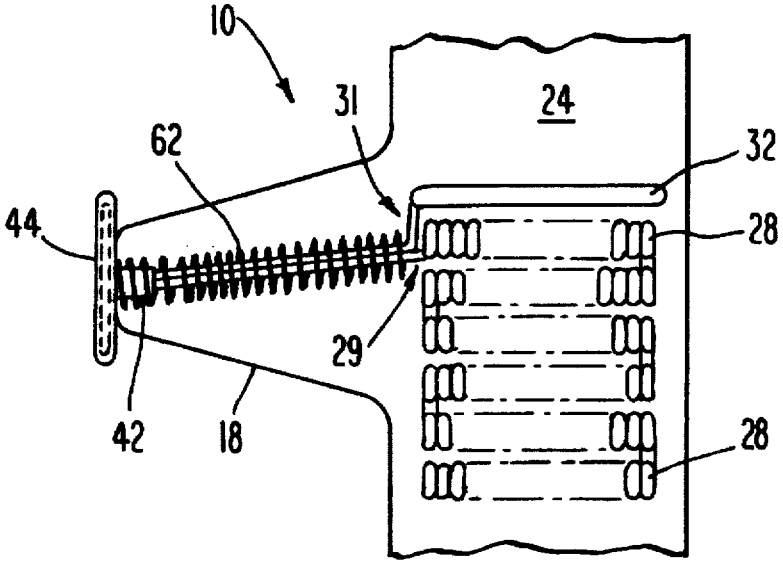
FIG. 2 is view similar to FIG. 1 depicting another portion of a dry-type transformer having a cast coil construction.
Figure 3:
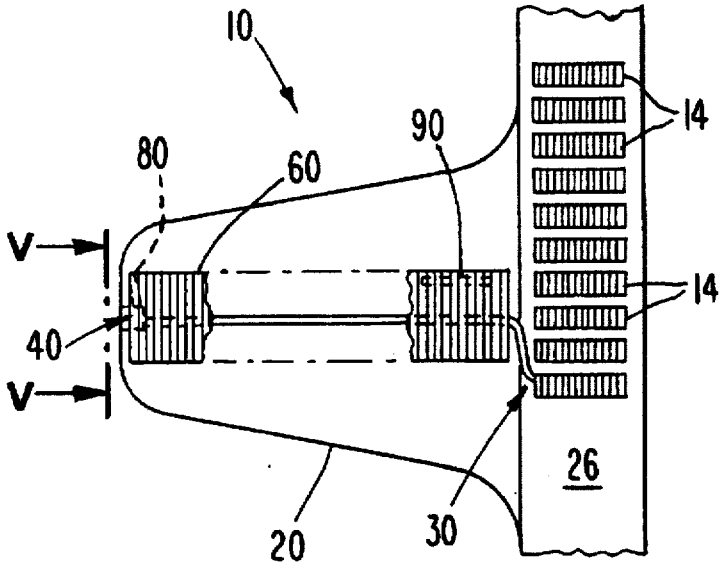
FIG. 3 is a view similar to FIGS. 1 and 2 depicting still another portion of a dry-type transformer having a cast coil construction.

In FIG. 2, the cone shaped portion 18 depicts, for example, the section of the transformer comprising another high voltage tap and in FIG. 3, the cone shaped portion 20 depicts, for example, the section of the transformer comprising still another high voltage tap. The sections 12, 18 and 20 are comprised of epoxy as are the portions 22, 24 and 26 in FIGS. 1, 2 and 3, respectfully. The epoxy material has a dielectric strength that is greater than air.

In dry-type transformers of cast-coil construction, the windings 14 (in FIG. 2, the windings are designated by the reference numeral 28) are locked into a molded form. The encapsulating epoxy resin protects the windings from the effects of moisture, chemicals, industrial and other deleterious atmospheres.

As shown in FIG. 1, the uppermost winding 14 has a finish lead shown generally at 30. In FIG. 3, the equivalent lead is also shown generally at 30 and, in FIG. 2, there is shown two leads, one (29) leading from the uppermost coil 28 and one (31) leading from the so-called static ring 32 shown disposed above the uppermost disc winding 28 in FIG. 2.

The leads 29, 30 and 31 are the portions of the transformer through which electrical connection may be made to the coils 14, 28 and to the static ring 32. Generally, the lead is comprised of an electrically conductive inner wire of copper or aluminum with insulation disposed around the inner conductive wire. The leads 29, 30 and 31 at their terminal portions 39 typically are affixed by brazing or welding to a tapped stud shown at 40 in FIGS. 1 and 3 and at 42 in FIG. 2. In FIG. 3, there is also shown a termination ring 44 to which the stud 42 is affixed, as for example by bolting the two members 42 and 44 together.

Figure 1A:
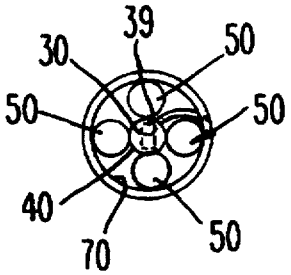
FIG. 1A is a view taken along the line A—A of FIG. 1.
Figure 3V:
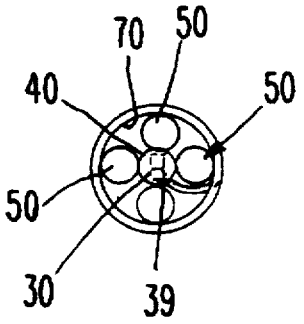
FIG. 3V is a view taken along the line V—V of FIG. 3.

As shown in FIGS. 1A and 3V by the reference numeral 50, there are a set of rolled fiberglass mats disposed around the leads 30. These same mats may, if desired, be in place around the leads 29 and 31 in FIG. 2. These mats 50 support the helical coil 60 shown in FIGS. 1 and 3 and the helical coil 62 shown in FIG. 2.

The helical coils 60 and 62 have a generally hollow cylindrical form with the lead 30 or leads 29, 31 passing axially through the generally hollow cylindrical form of the helical coils 60 and 62.

The helical coils 60 and 62 are formed of or comprise a conductive wire with (as in the case of FIGS. 1 and 2) or without (as in the case of FIG. 3) insulation being disposed thereon. The helical coils, in effect, comprise an elongated spiral or coil spring having a central opening 70) (See FIGS. 1A and 3V) therethrough. The leads 29, 30 and 31 pass axially through the opening 70 with the helical coils 60 and 62 being disposed in spaced surrounding relationship to the leads 29, 30 and 31. The helical coils 60 each have a first end 80, as best seen in FIGS. 1 and 3, which is affixed to the stud 40 and is therefore electrically connected to the stud 40. The helical coils 60 each have a second end 90, as best seen in FIGS. 1 and 3, which is folded into the central opening 70. It can thus be seen that second end of coil 60 is disposed within the opening 70 and in spaced apart relationship to the leads 30 (In FIGS. 1 and 3).

As shown, in FIG. 2, the helical coil 62 is disposed in surrounding and in spaced apart relationship to the leads 29 and 31. The leads 29 and 31 are affixed to and electrically connected to the stud 42 and one end thereof, i.e., the distal end thereof and the opposite end or proximal end thereof is merely terminated or "floating" but is not connected to the leads 29 and 31 in any fashion.

The helical coils 60 and 62 thus present a surface to any electrical field which may emanate from the leads 29, 30 and 31 and the helical coils, in accordance with the invention, are operative to control the electrical field which may be generated when current passes through the leads 29, 30 and 31. The helical coils 60/62 create a larger surface and thereby decrease dielectric stress on the epoxy material of the cones 12, 18 and 20 which results in less air space or insulation being required at a given potential. In other words, the cones may be made smaller and "live" parts in the vicinity of the cones can be closer (less air space) at a given potential than would otherwise be possible if the coils 60/62 were not present.

Obviously, modifications and variations of the present invention are possible in light of the above teachings. It is therefore to be understood that within the scope of the appended claims, the invention may be practiced otherwise than as specifically described herein.

Having thus described our invention:

What is claimed is:

1. A transformer comprising a core and at least one coil winding, said coil winding having a lead, and field control means operatively associated with said lead for controlling the electric field generated when said lead is carrying current said field control means comprising a conductive wire formed into an elongated spiral having a central opening therethrough, said lead passing through said opening.

2. In a transformer as set forth in claim 1 wherein said lead terminates at an electrically conductive member, said lead being electrically connected to said electrically conductive member and wherein said conductive wire forming said spiral has one end which terminates and is electrically connected to said electrically conductive member.

3. In a transformer as set forth in claim 2 wherein said conductive wire forming said spiral terminates at its opposite end within the central opening of said spiral.

4. A transformer comprising:

at least one coil, said coil having at least one lead through which an electrical connection is made to said transformer, and field control means disposed in surrounding relationship to said at least one lead for presenting a surface to any electrical field generated when said at least one lead carries current, said field control means comprising a conductive wire.

5. A transformer as set forth in claim 4 wherein said conductive wire is wound in the form of a helical coil.

6. A transformer as set forth in claim 5 wherein said helical coil of conductive wire has a central opening and said at least one lead is disposed within said central opening.

7. A transformer as set forth in claim 5 wherein said helical coil of conductive wire has a first and a second end, said first end being affixed to an end of said at least one lead and said second end being disposed in said central opening.

8. A transformer as set forth in claim 5 wherein said helical coil of conductive wire has insulation disposed thereon.

9. A transformer as set forth in claim 4 wherein said conductive wire is in the form of a coil spring.

10. A transformer as set forth in claim 9 wherein said conductive wire in the form of a coil spring has a central opening and said at least one lead extends through said central opening.

11. A coil for a transformer, said coil including a lead through which an electrical connection is made to said coil and field control means electrically connected to said lead for presenting a surface in spaced relationship to said lead, said surface being operative to control an electrical field emanating from said lead, said field control means comprising a helical coil of conductive wire.

12. A coil for an electrical apparatus, said coil comprising a lead through which an electrical connection is made to said coil and electric field control means electrically connected to said lead for providing a surface surrounding said lead, said electric field control means comprising a conductive wire.

13. A coil for an electrical apparatus as set forth in claim 12 wherein said conductive wire is formed into a helical coil having a first end and a second end, said first end being affixed to said lead and said second end being disposed in spaced relationship to said lead.

14. A coil for an electrical apparatus as set forth in claim 13 wherein said conductive wire has insulation disposed around it.

15. A coil for an electrical apparatus as set forth in claim 14 wherein said helical coil has a central opening, said lead being disposed in said central opening.

* * * * *

UNITED STATES PATENT AND TRADEMARK OFFICE

CERTIFICATE OF CORRECTION

PATENT NO. : 5,710,534

DATED : January 20, 1998

INVENTOR(S) : Thomas J. Lanoue; Terry D. Barber; Michael E. Haas

It is certified that error appears in the above-indentified patent and that said Letters Patent is hereby corrected as shown below:

Col. 2, line 63, "In FIG. 3, there is also shown" should read --In FIG. 2, there is also shown--

Signed and Sealed this

Seventh Day of April, 1998

Bruce Lehman

*Attest:*

BRUCE LEHMAN

*Attesting Officer*

*Commissioner of Patents and Trademarks*